US005630253A

United States Patent [19]

Benoit et al.

[11] Patent Number: 5,630,253

[45] Date of Patent: May 20, 1997

[54] BOOT AND ADJUSTABLE CLOSURE THEREFOR

[75] Inventors: Louis Benoit, La Balme De Sillingy; Laurent Marechal, Argonnay, both of France

[73] Assignee: Salomon S.A., Metz Tessy, France

[21] Appl. No.: 635,264

[22] Filed: Apr. 15, 1996

[30] Foreign Application Priority Data

Apr. 25, 1995 [FR] France ..... 95 05190

[51] Int. Cl.[6] ..... A43C 11/00

[52] U.S. Cl. ..... 24/70 SK; 24/71 SK

[58] Field of Search ..... 24/68 SK, 68 R, 24/69 SK, 70 SK, 71 SK; 36/50.1, 50.5

[56] References Cited

U.S. PATENT DOCUMENTS 4,674,156 6/1987 Olivieri ..... 24/70 SK

FOREIGN PATENT DOCUMENTS 0545965 10/1994 European Pat. Off. .
2109080 5/1972 France .
2561503 9/1985 France .
WO92/03071 3/1992 WIPO .

*Primary Examiner*—James R. Brittain
*Attorney, Agent, or Firm*—Greenblum & Bernstein P.L.C.

[57] ABSTRACT

A boot and a boot closure device adapted to bring two flaps of the boot close together including a control lever borne by a plate affixedly connected to one of the flaps, a rack connected to the other flap including a complementary arrangement for adjusting its position with respect to the lever. The arrangement for adjusting the rack are constituted by an adjustment zone that includes a buttonhole-shaped oblong slot obtained on the flap of the boot and demarcated by two circular end zones connected by a straight portion and whose diameter is equal to that of a locking pin affixed to the rack, and provided with a flat portion that is oriented perpendicular to the rack longitudinal displacement axis. The rack can be displaced, in view of its adjustment, from one end to the other of the buttonhole, after a rotation at 90° with respect to its longitudinal axis, to allow for its free sliding in the straight portion of the buttonhole, and locked in either one of the circular end zones by a 90° rotation in the opposite direction, bringing it back to a position where the flat portion of the pin is oriented perpendicular to the oblong slot.

17 Claims, 3 Drawing Sheets

Fig. 4
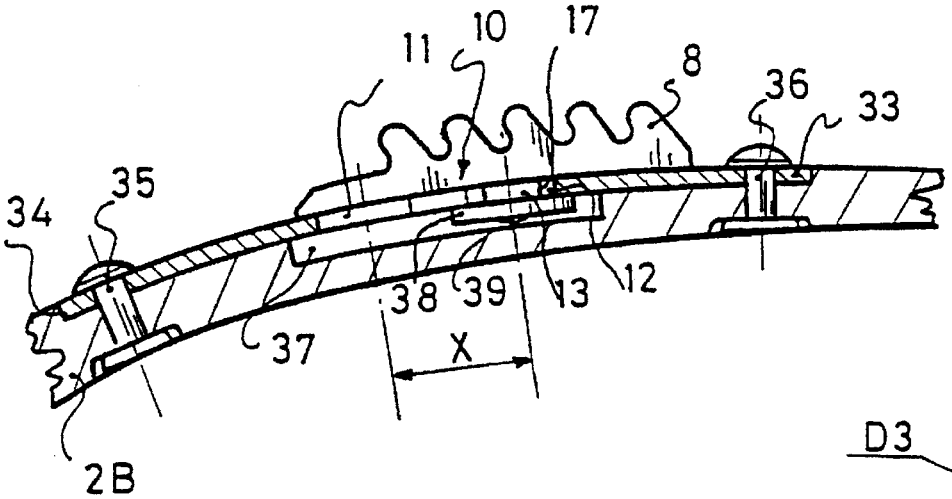
Fig. 6
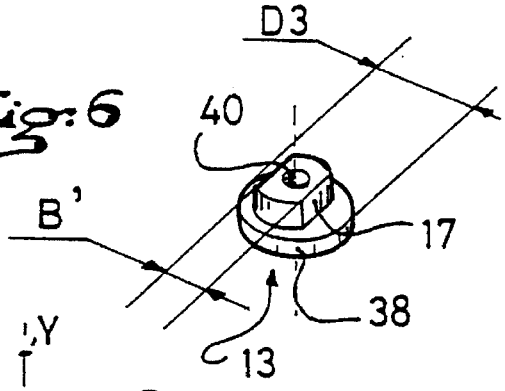
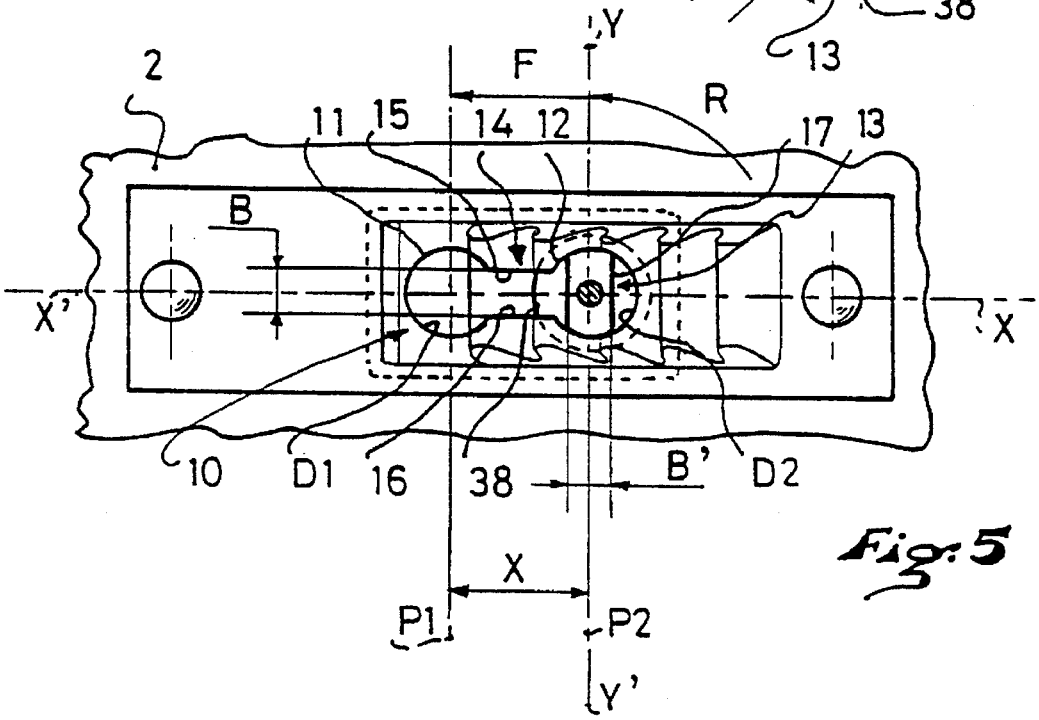
Fig. 5

BOOT AND ADJUSTABLE CLOSURE THEREFOR

BACKGROUND OF THE INVENTION

1. Field of the Invention

The present invention relates to a closure device for a boot, particularly a ski boot. Such closure devices are used to tighten two sections or flaps of a shell around a liner in which the skier's foot is enclosed.

The invention is related to closure devices that use a knuckle joint control lever, on the one hand, and a rack, on the other hand, which makes it possible to obtain at least a rough adjustment of the length of the device.

Such devices include complementary means for adjusting the position of the rack with respect to the lever, making it possible to increase the tightening capacity thereof which adds to that obtained traditionally by the choice of a tooth with which a hooking member is capable of cooperating, such hooking member being in turn connected to the control lever.

2. Description of Background and Relevant Information

European Patent Publication No. 545 965 describes a closure device of the aforementioned type in which a complementary adjustment of the position of the rack is obtained by means of an eccentric whose axis can be displaced along a longitudinal direction and in the transverse direction of a traction member, the eccentric being furthermore connected to a notched element that is capable of being blocked or released by a tightening member.

This device has the major disadvantage of requiring a member, such as a screw for example, to be loosened before moving the eccentric. Moreover, this involves having an appropriate tool which adds to the constraint of the intervention occurring over a more or less long period of time. Furthermore, such a system involves the necessity of aligning the notches of the eccentric before tightening the assembly.

French Certificate of Utility No. 2 561 503 describes a device for adjusting the notches that are located at its lower portion and cooperate with a stop member acting in the direction of traction of a tie rod to which it is connected, maintenance in the selected position being made by means of an elastic thrust means. Such a system is not only very costly due to the number of elements to be used, but it also has the disadvantage of being unreliable due to the fact that the shocks which it is capable of receiving in such an exposed area can lead to a separation of the rack from its immobilization and adjustment means.

French Patent Publication No. 2 109 080 teaches making a complementary adjustment in a closure device, but unlike the preceding ones, the rack is borne by the control lever itself, and the complementary adjustment means are obtained on the base of a hooking stirrup at the level of its binding on the other flap of the boot. In this case, the tightening adjustment is made on each flap of the boot and requires separation of the hooking stirrup from the lever rack to allow for the complementary adjustment thereof, which involves ample movements, that are not always easy to make, by the user.

SUMMARY OF THE INVENTION

An object of the present invention is to overcome the different disadvantages pertaining to the aforementioned known devices, particularly by providing a double tightening adjustment on a single element mounted on a flap of the boot.

To this end, it relates to a closure device for a boot, especially a ski boot, adapted to maintain two flaps of the boot close together and comprising, on the one hand, a control lever borne by a plate fixedly connected to one of the flaps to be brought close together, and on the other hand, a rack, on the other flap, comprising complementary means for adjusting its position with respect to the lever making it possible to increase the tightening capacity thereof. A hooking member is capable of engaging in one of the teeth of the rack, the hooking member itself being connected to the control lever by an inextensible tie rod wherein the rack adjustment means are constituted by an adjustment zone comprising a buttonhole-shaped oblong slot obtained on the flap of the boot at right angles with a lower surface of the rack and demarcated by two circular end zones whose diameter is equal to that of a locking pin affixed to the lower surface of the rack and traversing the buttonhole to be retained axially therein, the circular zones being connected between them by a straight portion with parallel edges spaced from one another along a value equal to that of a flat portion of the pin of the rack that is obtained in a direction perpendicular to the longitudinal axis of displacement thereof, such that the latter can be displaced, in view of its adjustment, from one end to the other of the buttonhole, after a 90° rotation with respect to its longitudinal axis to allow for the free sliding of the flat zone of the pin, therefore that of the rack in either of the circular end zones, by a 90° rotation in the opposite direction, bringing the rack back to a functional longitudinal position.

The present invention is also related to the characteristics that will become apparent from the following description, and which must be considered separately or according to all their possible technical combinations.

BRIEF DESCRIPTION OF THE DRAWINGS

Other characteristics and advantages of the invention will be better understood upon reading the description that follows and with reference to the annexed drawings giving, by way of example, several embodiments applied to a ski boot.

FIG. 4 is a partial lateral view of a closure device according to another embodiment;

FIG. 5 is a top view of a partially cutaway view of the rack to show its complementary means according to the invention;

FIG. 6 is a perspective detailed view showing an adjustment pin separated from the rack.

DETAILED DESCRIPTION OF THE PREFERRED EMBODIMENTS

Figure 1:
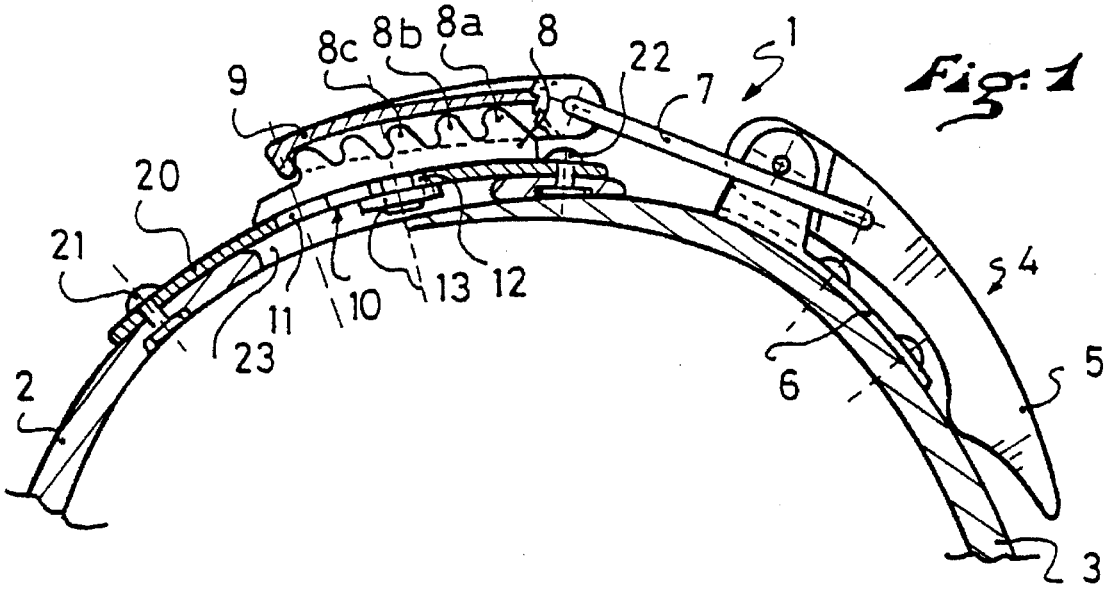
FIG. 1 is a general lateral view of a boot closure device, according to a non-limiting embodiment, shown in a minimum tightening position.

According to the embodiment shown in the figures, the closure device generally designated by reference numeral 1 is adapted to ensure the coming close together of two flaps 2 and 3 of the boot.

In this example, the device 1 comprises a control lever 4 of the knuckle joint type. Such lever 4 is known, per se, and comprises an arm 5 connected to the flap 3 of the boot by means of a plate 6. An extensible tie rod 7 is fixed in a journalled manner on the arm 5 of lever 4, and is adapted to be connected to a rack 8 by means of an inextensible hooking or latching member 9 that is capable of cooperating with at least one of the teeth 8*a*, 8*b*, 8*c*, . . . , thereof.

The rack 8 is fixed on the flap 2 of the boot whereas the lever 4 is fixed on the other flap 3 to be brought closer.

The rack 8 comprises complementary means for adjusting its position with respect to the lever 4 in order to increase its tightening capacity that adds to that obtained by the cooperation of one of its teeth 8*a*, 8*b*, 8*c*, . . . , with the hooking element 9.

According to the invention, this adjustments means or position adjustment mechanism is generally constituted by a buttonhole-shaped oblong slot 10 formed in an adjustment zone of flap 2 of the boot at right angles with a lower surface of the rack 8, and demarcated by two circular end zones 11 and 12 whose respective diameters D1 and D2 are identical and equal to that of a locking pin 13 affixed to the lower surface of the rack 8. Pin 13 extends through the buttonhole 10 to be retained axially therein. The circular zones 11 and 12, and the buttonhole 10 are connected between them by a straight portion 14 with parallel edges 15 and 16 spaced apart by a value B that is equal to the value B' of a flat portion 17 of the pin 13 of the rack 8. The flat portion 17 of the pin is oriented along a direction Y–Y' perpendicular to the longitudinal axis X–X' of displacement thereof when the rack is locked. In this way, the rack 8 can be displaced along direction F, in its adjustment, from one end 11 to the other end 12 of the buttonhole 10, after a rotation R at 90° with respect to its longitudinal axis X–X' to allow for the free sliding of the flat zone 17 of the pin 13 in the straight portion 14 of the buttonhole 10 and the locking of the pin 13 and, therefore the locking of the rack 8, in either one of the circular end zones 11 and 12, by a 90° rotation in the opposite direction, bringing the rack 8 back to a functional longitudinal position.

In this manner, and as shown particularly in FIG. 5, the rack 8 can be placed in a position P1 or P2 that varies according to a displacement value X.

A particularly interesting advantage of the invention lies in the fact that the rack 8, once adjusted, can move angularly with respect to the longitudinal axis of its support, thus being able to align itself with the control lever 4 when the flaps 2 and 3 become deformed during the tightening operation, or during ski practice, depending upon the movements of the skier's foot and the possible deformations of the boot shell.

To reinforce the adjustment zone on which the buttonhole 10 is obtained, the latter is constituted by an overmolding of a relatively rigid plastic material on the relevant flap 2 of the boot.

Figure 2:
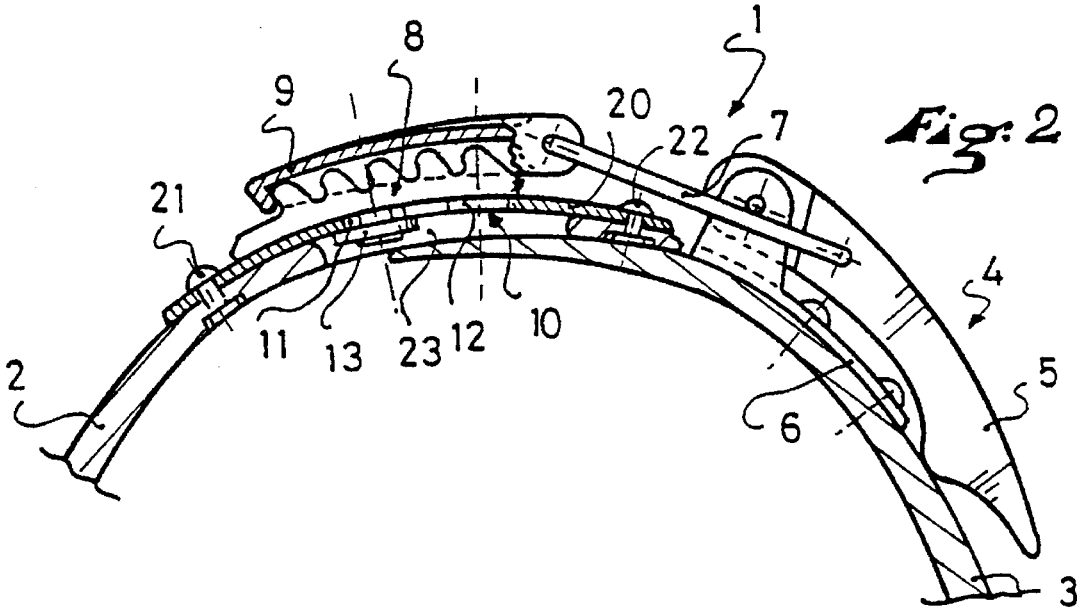
FIG. 2 is a view according to FIG. 1 in which the device is shown in a maximum tightening position.

According to the embodiment shown in FIGS. 1 and 2, the adjustment zone on which the buttonhole 10 is made is constituted by a relatively planar rigid support plate 20 on which the rack 8 is slidably fixed beforehand, and which is attached to the flap 2 of the boot by means of two fixing rivets 21 and 22 at its ends. The flap 2 of the boot is itself provided with an opening 23 that extends through its entire thickness and is able to allow for the free movement of the pin 13 of the rack 8 during a subsequent adjustment.

Figure 3:
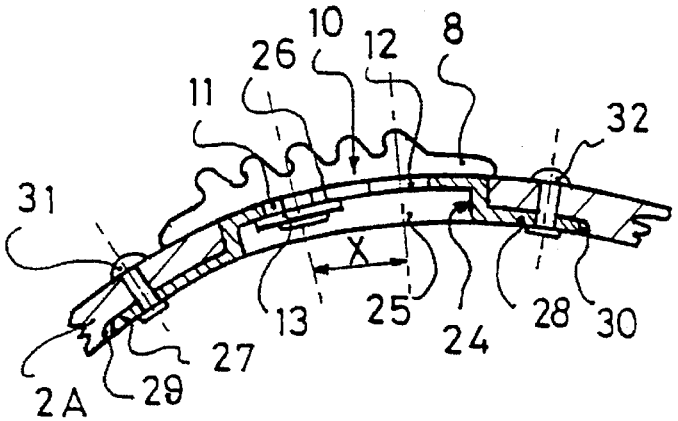
FIG. 3 is a partial lateral view of a closure device according to a variation of the aforementioned embodiment.

According to the example of FIG. 3, the adjustment zone on which on which the buttonhole 10 is obtained is constituted by an omega-shaped rigid support plate 24 of which a central portion in form of an inverted U is adapted to be housed in a transverse opening 25 of the flap 2A of the boot, a relatively planar upper portion 26 constituting the horizontal arm of the U comprises the buttonhole 10 in which the rack 8 is slidably fixed beforehand, and brushes the outer surface of the flap 2A of the boot. The lateral arms 27 and 28 of the omega extending in opposite directions are housed in recesses 29 and 30 obtained on the inner surface of the flap 2A of the boot and receive two fixing rivets 31 and 32 crossing it right through.

According to the example of FIG. 4, the adjustment zone on which the buttonhole 10 is made is constituted by a relatively planar rigid support plate 33 on which the rack 8 is slidably fixed beforehand, and which is attached to a housing 34 with corresponding shape and thickness obtained on the outer surface of the flap 2B of the boot to be fixed thereto by means of two rivets 35 and 36 at its ends, the flap 2B comprising, at right angles with the buttonhole 10, a blind housing 37 whose dimensions are capable of allowing for the free movement of the pin 13 borne by the rack 8 during a subsequent adjustment thereof.

This embodiment offers numerous advantages, namely:

is the flap 2B is not open right through, therefore there is less risk of fatigue, of deformation during tightening and of lack of sealing;

no visible portion inside the boot except for the fixing rivets 35 and 36;

the support plate 33 is particularly simple; and the possibility of separate mounting of a complete subassembly.

According to the example of FIGS. 1–4, the axial retention of the locking pin 13 and of the rack 8 on the flap 2 of the boot in the adjustment zone is made by means of an enlarged circular zone 38 of the pin 13 taking support beneath the adjustment buttonhole 10, and whose dimension D3 is at least greater than those D1 and D2 of the circular end zones 11 and 12 thereof.

In this case, the pin 13 is made distinct from the rack 8 and forms at its base a collar constituting the enlarged support zone 38. The linkage of such pin 13 on the rack 8, in a sliding manner, is formed by means of a perpendicular cylindrical portion or axle 39 originating from the lower surface of the rack 8 and extending through hole an axial 40 of the pin 13 to be affixed thereto.

The linkage and the immobilization in rotation of the pin 13 on the axle 39 of rack 8 is done by riveting of the end of the axle 39. Thus, the support plate 20, 24 or 33 is sandwiched between the collar 38 of the pin 13 and the lower surface of rack 8.

Figure 7:
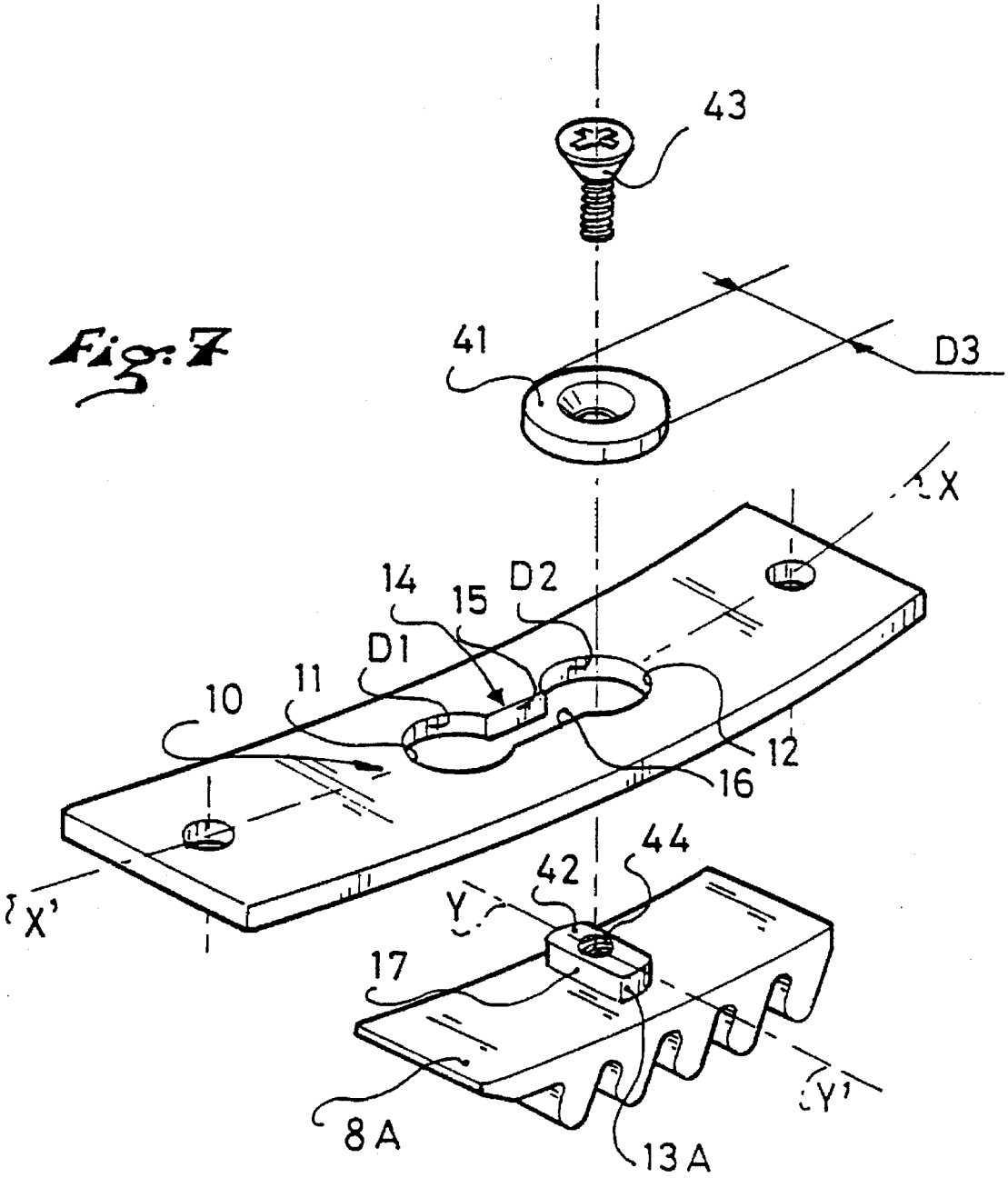
FIG. 7 is an exploded perspective detailed view of a rack provided with an adjustment pin affixed thereto.

According to an embodiment of FIG. 7, the pin 13A, having flat portions 17, is made integral with the rack 8A. The enlarged axial retention zone of the pin 13A, therefore of rack 8A, is constituted in this case by a circular washer 41 attached on the free base 42 of pin 13A, after insertion in the buttonhole 10 by means of a screw 43 that is tightened in an axial threaded hole 44 thereof.

The instant application is based upon French Patent Application No. 95.05190, filed on Apr. 25, 1995, the disclosure of which is hereby expressly incorporated by reference thereto in its entirety and the priority of which is claimed under 35 USC 119.

Although the invention has been described with reference to particular means, materials, and embodiments, it is to be understood that the invention is not limited to the particulars expressly disclosed, but the invention extends to all equivalents within the scope of the claims that follow.

What is claimed is:

1. A closure device for a boot, including a ski boot, for maintaining a pair of flaps of the boot close to each other in a latched position, said closure device comprising:

a control lever;

a plate adapted to be mounted upon one of the pair of flaps of the boot, said lever being mounted upon said plate for manipulation for movement for selective latching and unlatching the device;

a rack having a plurality of teeth, said rack being adapted to be affixed to a second of the pair of flaps of the boot;

a latching member having a portion shaped for engagement with at least one of said teeth of said rack;

an inextensible member connecting said latching member to said control lever; and a rack position adjustment mechanism, said mechanism comprising:

a member having a buttonhole-shaped oblong slot adapted to be fixed with respect to the second of the pair of flaps of the boot, said slot including a pair of opposite circular end portions connected by a straight portion, said circular portions having a common predeterminate diameter and said straight portion having a predeterminate width;

a pin affixed to a lower surface of said rack, said pin having a projecting portion extending through said oblong slot;

said projecting portion of said pin having a pair of opposed flat sides and a pair of opposed arcuate sides, said flat sides being spaced apart by a distance substantially equal to said predeterminate width of said straight portion of said oblong slot, said arcuate sides of said projecting portion of said pin having diameter substantially equal to said predeterminate diameter of said circular end portions of said oblong slot;

said rack being adapted to be rotated about said pin from a functional locked position to a movable position, whereby:

in said functional locked position, said pin is positioned in one of said circular portions of said oblong slot and said flat sides of said projecting portion of said pin extend in a direction perpendicular to a longitudinal direction of said oblong slot; and in said movable position, said rack is rotated +90° with respect to the longitudinal slot; and in said movable position, said rack is rotated +90° with respect to the longitudinal direction of said oblong slot and said flat sides of said projecting portion of said pin extend parallel to said straight portion of said oblong slot to enable movement of said pin through said straight portion of said oblong slot from one of said circular portions to the other of said circular portions, following said movement of said pin through said straight portion of said oblong slot, said rack being adapted to be rotatable −90° to said functional locked position to thereby effect a longitudinal adjustment of said rack.

2. A closure device according to claim 1, wherein:

said pin further comprises an enlarged portion positioned on a side of said oblong slot opposite from said rack, said enlarged portion having a dimension larger than said diameters of said circular portions of said oblong slot to thereby axially retain said pin and said rack on the second of the pair of flaps.

3. A closure device according to claim 2, wherein:

said enlarged portion of said pin is distinct from said projecting portion of said pin and said rack, said enlarged portion comprising a circular washer; and said pin further includes a screw extending through said washer and being threadably engaged in said projecting portion.

4. A closure device according 2, wherein:

said projecting portion of said pin is distinct from said rack, said enlarged portion of said pin is constituted by a flange integral with said projecting portion; and said pin being connected to said rack by means of a cylindrical member extending from a lower surface of said rack, said projecting portion of said pin having a hole therein, said cylindrical member being fitted within said hole in said projecting portion.

5. A closure device according to claim 1, wherein:

said member having a buttonhole-shaped oblong slot comprises a generally planar rigid support plate adapted to be mounted on the second of the pair of flaps of the boot by means of a pair of rivets on opposite ends of said support plate, the second of the pair of flaps of the boot on which the support plate is adapted to be mounted is provided with an opening extending therethrough to allow free movement of said pin with respect to said oblong slot.

6. A closure device according to claim 1, wherein:

said member having a buttonhole-shaped oblong slot comprises an omega-shaped rigid support plate, including a central portion having an inverted U-shape, said inverted U-shape having an intermediate generally planar section, said support plate having a pair of opposite arms, said central portion of said support plate being adapted to be housed in a transverse opening of the second of the pair of flaps of the boot, said buttonhole-shaped oblong slot being formed in said intermediate section of said inverted U-shape, said intermediate section being adapted to be flush with an outer surface of the second of the pair of flaps of the boot and said pair of opposite arms are adapted to be housed in respective recesses formed in an inner surface of the second of the pair of flaps of the boot and adapted to be affixed thereto by means of a pair of rivets extending through respective ones of said opposite arms.

7. A closure device according to claim 1, wherein:

said member having a buttonhole-shaped oblong slot comprises a generally planar rigid support plate adapted to be mounted on the second of the pair of flaps of the boot in a housing extending in an outer surface of the second of the pair of flaps of the boot by means of a pair of rivets on opposite ends of said support plate, the housing having a corresponding shape and thickness of said support plate, the second of the pair of flaps of the boot adapted to have a blind housing within the housing, the blind housing having dimensions to allow free movement of said pin with respect to said oblong slot.

8. A closure device according to claim 1, wherein:

said member having a buttonhole-shaped oblong slot comprises a thickened rigid portion of the second of the pair of flaps of the boot.

9. A boot having a first flap, a second flap and a closure device for maintaining said flaps close to each other in a latched position, said boot comprising:

a control lever;

a plate mounted upon the first flap, said lever being mounted upon said plate for manipulation for movement for selective latching and unlatching the device;

a rack having a plurality of teeth, said rack being affixed to said second flap;

a latching member having a portion shaped for engagement with at least one of said teeth of said rack;

an inextensible member connecting said latching member to said control lever; and a rack position adjustment mechanism, said mechanism comprising:

a member having a buttonhole-shaped oblong slot fixed with respect to said second flap, said slot including a pair of opposite circular end portions connected by a straight portion, said circular portions having a common predeterminate diameter and said straight portion having a predeterminate width;

a pin affixed to a lower surface of said rack, said pin having a projecting portion extending through said oblong slot;

said projecting portion of said pin having a pair of opposed flat sides and a pair of opposed arcuate sides, said flat sides being spaced apart by a distance substantially equal to said predeterminate width of said straight portion of said oblong slot, said arcuate sides of said projecting portion of said pin having diameter substantially equal to said predeterminate diameter of said circular end portions of said oblong slot;

said rack being adapted to be rotated about said pin from a functional locked position to a movable position, whereby:

in said functional locked position, said pin is positioned in one of said circular portions of said oblong slot and said flat sides of said projecting portion of said pin extend in a direction perpendicular to a longitudinal direction of said oblong slot; and in said movable position, said rack is rotated +90° with respect to the longitudinal direction of said oblong slot and said flat sides of said projecting portion of said pin extend parallel to said straight portion of said oblong slot to enable movement of said pin through said straight portion of said oblong slot from one of said circular portions to the other of said circular portions, following said movement of said pin through said straight portion of said oblong slot, said rack being adapted to be rotatable −90° to said functional locked position to thereby effect a longitudinal adjustment of said rack.

10. A boot according to claim 9, wherein:

said pin further comprises an enlarged portion positioned on a side of said oblong slot opposite from said rack, said enlarged portion having a dimension larger than said diameters of said circular portions of said oblong slot to thereby axially retain said pin and said rack on said second flap.

11. A boot according to claim 10, wherein:

said enlarged portion of said pin is distinct from said projecting portion of said pin and said rack, said enlarged portion comprising a circular washer; and said pin further includes a screw extending through said washer and being threadably engaged in said projecting portion.

12. A boot according 10, wherein:

said projecting portion of said pin is distinct from said rack, said enlarged portion of said pin is constituted by a flange integral with said projecting portion; and said pin being connected to said rack by means of a cylindrical member extending from a lower surface of said rack, said projecting portion of said pin having a hole therein, said cylindrical member being fitted within said hole in said projecting portion.

13. A boot according to claim 9, wherein:

said member having a buttonhole-shaped oblong slot comprises a generally planar rigid support plate mounted on the second flap of the boot by means of a pair of rivets on opposite ends of said support plate, said second flap of the boot is provided with an opening extending therethrough to allow free movement of said pin with respect to said oblong slot.

14. A boot according to claim 9, wherein:

said member having a buttonhole-shaped oblong slot comprises an omega-shaped rigid support plate, including a central portion having an inverted U-shape, said inverted U-shape having an intermediate generally planar section, said support plate having a pair of opposite arms, said central portion of said support plate being housed in a transverse opening of said second flap of the boot, said buttonhole-shaped oblong slot being formed in said intermediate section of said inverted U-shape, said intermediate section being flush with an outer surface of said second flap of the boot and said pair of opposite arms are housed in respective recesses formed in an inner surface of said second flap of the boot and affixed thereto by means of a pair of rivets extending through respective ones of said opposite arms.

15. A boot according to claim 9, wherein:

said member having a buttonhole-shaped oblong slot comprises a generally planar rigid support plate mounted on said second flap of the boot in a housing extending in an outer surface of said second flap by means of a pair of rivets on opposite ends of said support plate, the housing having a corresponding shape and thickness of said support plate, said second flap of the boot having a blind housing extending within said housing, said blind housing having dimensions to allow free movement of said pin with respect to said oblong slot.

16. A boot according to claim 9, wherein:

said member having a buttonhole-shaped oblong slot comprises a thickened rigid portion of said second flap of the boot.

17. A boot according to claim 9, wherein said boot is a ski boot.

* * * * *